United States Patent [19]

Shapiro

[11] Patent Number: 4,881,741

[45] Date of Patent: Nov. 21, 1989

[54] JUGGLING SYSTEM FOR AMUSEMENT, EXERCISING AND TRAINING

[76] Inventor: James R. Shapiro, 10 Malibu Ct., Towson, Md. 21204

[21] Appl. No.: 291,657

[22] Filed: Dec. 29, 1988

[51] Int. Cl.[4] ..... A63B 67/00

[52] U.S. Cl. ..... 273/327; 273/428

[58] Field of Search ..... 273/317, 327, 344, 428

[56] References Cited

U.S. PATENT DOCUMENTS

| | | | |
|---|---|---|---|
| D. 120,840 | 3/1940 | Singer | 273/344 X |
| 1,385,642 | 7/1921 | Restein | 273/428 X |
| 2,364,137 | 7/1943 | Gibb | 273/428 |
| 2,377,498 | 1/1944 | Jacke | 273/428 |
| 3,433,809 | 5/1969 | Montanez | 273/428 X |
| 3,514,109 | 1/1968 | Grow | 273/428 X |
| 3,528,659 | 10/1966 | Benham | 273/327 |
| 3,655,193 | 4/1972 | Jones | 273/344 |
| 3,746,334 | 7/1973 | Stubblefield | 273/428 X |
| 3,942,790 | 3/1976 | Rice | 272/79 R |
| 4,750,745 | 6/1988 | Benham | 273/327 |

OTHER PUBLICATIONS

"Flix Stix" Advertising Brochure, Undated, "Flix Stix Unlimited".

*Primary Examiner*—William H. Grieb

*Attorney, Agent, or Firm*—Jones, Tullar & Cooper

[57] ABSTRACT

A system for juggling manipulation has a projectile rod assembly (10) for being dynamically sustained by upward blows by a stick (32). The projectile rod assembly is composed of a rod (24) with flexible cups (20,22) on the respective ends of the rod that can be axially reversed by blows from the stick in flight. The stick can engage elastomeric loop (46) around the rod and serve to twirl the projectile rod assembly, and alternatively can be used to drive the loops up and down the rod changing balance in flight. The flexible cups may have scalloped edges (40,42,44) for engagement by the stick (32). Two sticks may be used for the juggling. Changes in manipulative characteristics may be made in flight by these provisions.

14 Claims, 4 Drawing Sheets

JUGGLING SYSTEM FOR AMUSEMENT, EXERCISING AND TRAINING

TECHNICAL FIELD

My invention relates to juggling systems and particularly to improvement for purposes of amusement, exercising and training of the known type juggling system that employs a rod capped on each end with a respective enlargement and with it, one or a pair of sticks that may have preferably an end-enlargement or "hat"-shaped guard for manual use in juggling manipulation or dynamic sustainment of a capped rod. The capped rod is called for purposes of this invention a "projectile rod assembly" and the end enlargements, "caps" or "cuts".

In juggling exercising and training with such systems it is important to provide varying degrees of challenge so that skill in juggling may progressively advance, particularly as this is done by changing shape, balance and other handling characteristics.

BACKGROUND ART

In the prior art, U.S. Pat. No. 2,364,137 provided a rod with a conical intermediate enlargement and two sticks with which to juggle the rod, by tossing it back and forth in the air between the two sticks; U.S. Pat. No. 2,377,498 provided for a rod that could be capped at the ends with caps of selected shapes; spherical, concave outward, concave inward, and others, all having sockets to hold them on the rod ends; U.S. Pat. No. 3,528,659 provided a rod capped with an inwardly-concave pliable cup at each end having a pair of sticks for tossing and twirling the rod in the air; U.S. Pat. No. 3,746,334 provided a practice javelin having a rod, a conical member with a notched skirt adjacent each respective end of the rod, and a sleeve intermediate the ends of the rod. In these patents the shape of the caps remains fixed unless disassembled, when presumably other caps could be substituted. Various juggling routines could be performed with any of the above, using sticks for manipulation, and such is known particularly with rods with rigid spheres on the ends.

DISCLOSURE OF THE INVENTION

In accordance with the present invention, I provide a projectile rod assembly made of a rod with flexible end caps in the form of cups. Each cup has at least two stable axial positions of flexure along the rod that can be used with at least one hand-held, preferably "hat"-equipped (large end) stick for differently manipulating the projectile rod assembly. The flexure provision can alter dynamic sustainment characteristics of the projectile rod assembly in that it alters the length, balance, symmetry and shape of the projectile rod assembly, without disassembly. Each of the projectile rod assembly hand-held manipulating "sticks" has a hat-shaped guard or fitting that can interact during manipulation with the projectile rod assembly in different ways.

As will be described, these features have particular advantages compared to combinations of prior art rod end caps and sticks, and make possible new modes of juggling and training with the system.

BRIEF DESCRIPTION OF THE DRAWINGS

The details of my invention will be described in connection with the accompanying drawing, in which various views are to different scales, for exposition purposes.

BEST MODE FOR CARRYING OUT INVENTION

Figure 1:
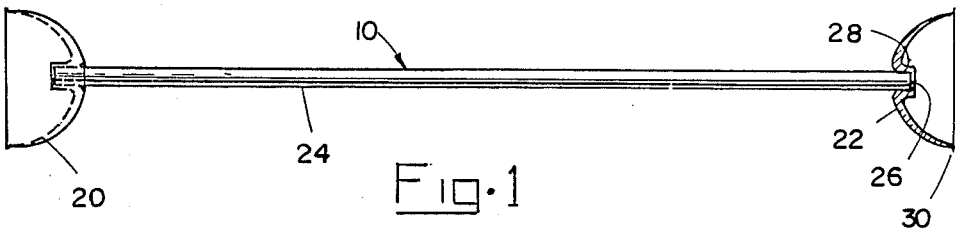
FIG. 1 is a side elevation of a projectile rod assembly with the flexible end caps in axially outwardly extended position, one of the end caps being shown in sectional view.

Referring to the drawings, FIGS. 1, 2, 3 and 4 show a projectile rod assembly in embodiment 10, in three positions to which enlargements or cups 20, 22 on the ends of a rod 24 may be flexed in accordance with my invention. The cups 20, 22 are fixed on the rod ends by respective portions of the cups forming coaxial socket structures with a safety cushioning closed end 26 on each socket structure 28.

The cups are molded in hemi-spherical shape with concave end (cup shape), and may be of flexible, durable and size-stable, polyvinyl chloride material. The material is available commercially. It can be molded to any desired shape and surface finish. Thickness of each cup 20, 22 preferably is substantially 1.5 mm, and wall thickness of the sockets is also 1.5 mm. Thickness is exaggerated for exposition in the drawings.

The cups may be the same shape and size; outer rim diameter may be 8 cm, overall length axially may be 4 cm when in coaxially outward facing concave mode as at FIG. 1. In this mode the cup rim 30 may extend axially beyond the rod 24 a distance of 2 cm. Other sizes and materials may be substituted for those given without departing from the spirit of the invention.

Figure 2:
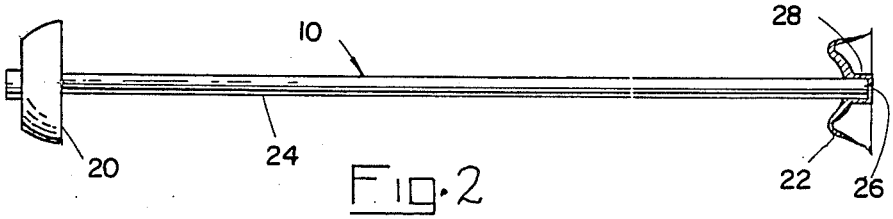
FIG. 2 is a side elevation thereof with the flexible end caps in an intermediate position axially half-folded back over themselves, one of the end caps being shown in sectional view.

In the second position, FIG. 2, or centrally folded mode each cup is flexed back over itself axially as at 20, 22, about half the length of the cups, covering the inner half thereof. Frictional force on compression of the inner half by the outer half makes this position somewhat stable, that is, for a few seconds at least. The resilient cup material may creep and snap into either the FIG. 1 or the FIG. 3 position. On the other hand, the stick may be used to drive the cup to either of the other positions while the projectile rod assembly is in midair.

Figure 3:
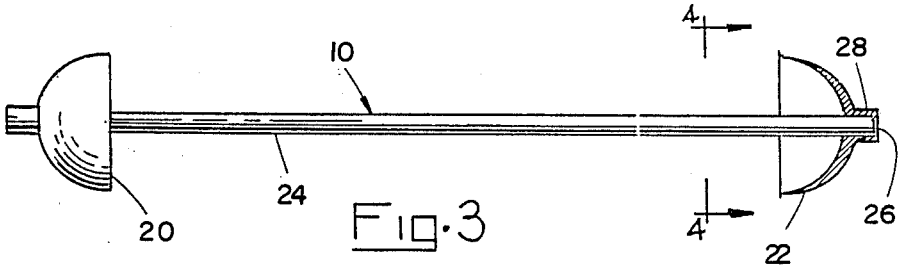
FIG. 3 is a side elevation thereof with the flexible end caps in axially inwardly extended position, one of the end caps being shown in sectional view.

In the third position, FIG. 3, or inwardly folded mode, each of the cups 20, 22 is fully extended inwardly and the radial force on the cup at the socket structure 28 stabilizes it.

To hold a cup 20, 22 on the rod 24, the inside diameter of the socket 28 may be 10% less than the outside diameter of the rod 24. The rod is preferably a wooden dowel 9 mm in diameter by 62 cm long, although it may be longer or shorter to suit the user, and of other diameter.

FIG. 3 shows the cups 20, 22 flexed to an inwardly concave position with the socket structure 28 protruding axially, free of the cup shape. Dimensions are the same as for the FIG. 1 position.

It will be appreciated that either cup 20, 22 can be placed in any of the positions shown independently of the other cup, and that the prior art made no such provision for altering size, shape, balance and juggling characteristics.

Figure 4:
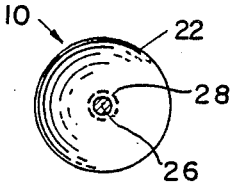
FIG. 4 is a view of the FIG. 1 depiction; at 4—4, FIG. 3.

FIG. 4 is a sectional view taken at 4—4, FIG. 3, showing axial relation of features 22, 26, and 28.

Figure 5:
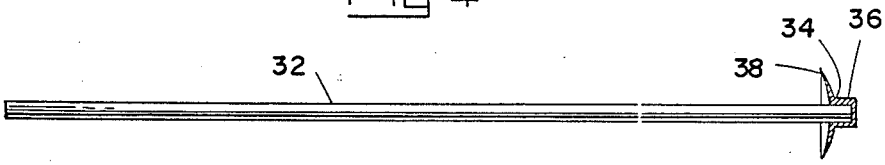
FIG. 5 is a side elevation of a stick showing in sectional view a guard on an end thereof.

FIG. 5 shows a stick 32 with which projectile rod assembly is manipulated. Preferably two such sticks are provided, each about 62 cm long and 1 cm in diameter, of wood such as birch or any suitable plastic. A hat-shaped circular guard 34 is fixed coaxially on one end of the stick by means of a socket shaped portion 36 of the guard. The other end is held in the user's hand. The brim 38 of the hat shape serves not only as part of the guard but also for pickup of the projectile rod assembly in manipulation, as by hooking the projectile rod assembly, as will be described later.

Dimensions of the hat-shaped guard 34 may be about 1.5 mm thickness, 4 cm brim diameter and 3 cm socket length.

The stick 32 (or sticks, if two are used) are manually manipulated and cyclically thrust from below against the rod 24 or the cup 20 (or cups 20, 22 if the projectile rod assembly is spun) during juggling, producing dynamic sustainment of the projectile rod assembly 10. The dynamic sustainment characteristics are changed when desired by axially flexing and moving one or both of the axially disposed cup assemblies to one of the first, second or third positions, as selected.

Figure 6A:
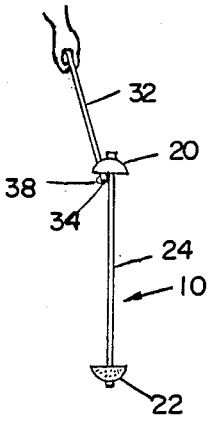
FIG. 6*a* and FIG. 6*b* are perspective views of the projectile rod assembly being juggled or dynamically sustained with a stick.
Figure 6B:
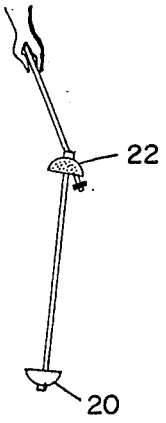

FIG. 6*a* shows how the brim 38 of a hat-shape guard 34 on an end of a stick 32, can be inserted or hooked in a reversed cup 20 turned inward to the third position and rotated about the cup, or else the projectile rod assembly 10 can be flipped by stick 32 so that opposite end cups 20, 22 can be cyclically engaged in juggling manipulation or dynamic sustainment of the projectile rod assembly as shown in FIG. 6*b*.

Also, it can be spun around, be released, and caught by other stick, and continued to spin, with the other stick. Stipling indicates different colors, for exposition.

Figure 7:
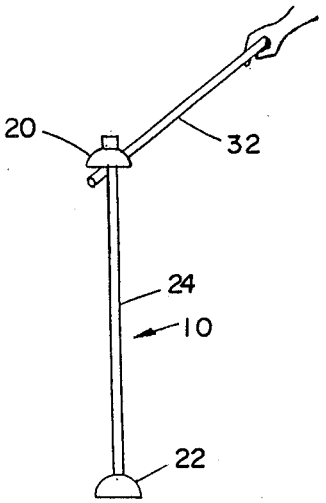
FIG. 7 is a perspective view thereof in another mode of adjustment of the projectile rod assembly, with a stick.

FIG. 7 shows one of the cups 20 adjustably flexed inward to the third position on a projectile rod assembly 10 and alternately engaged by the side of a stick 32 with an outwardly turned cup 22 on the other end of the projectile rod assembly 10, varying the challenges in engaging the cups.

Figure 8A:
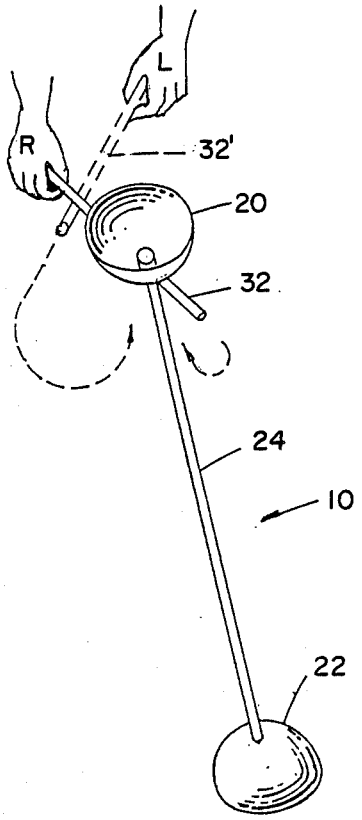
FIGS. 8*a* and 8*b* show in perspective view successive steps in manipulation of the projectile rod assembly in another mode of adjustment.
Figure 8B:
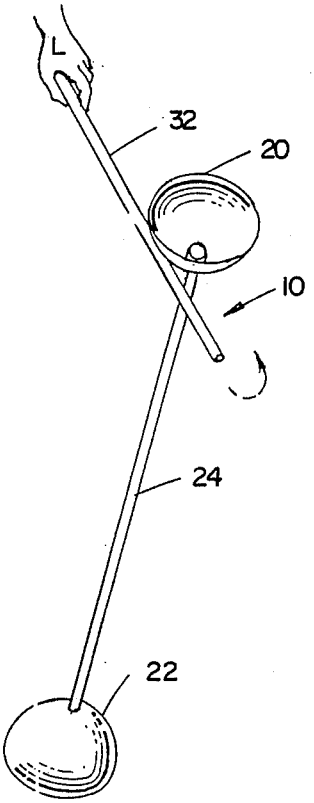

FIGS. 8*a* and 8*b* show successive positions in a so-called "swordsman" routine, a first stick 32 being first stabbed, FIG. 8a, to the left of the cups 20, 22 which are flexed into the first position and then to the right, cyclically, FIG. 8*b*. A second stick 32′ can be used for every other stab, if desired.

Figure 9:
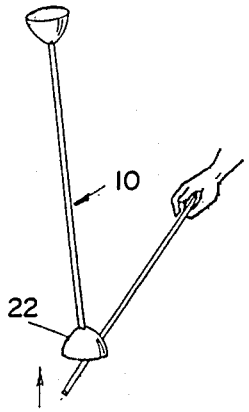
FIG. 9 is an elevational view of another mode of manipulation, sustaining the projectile rod assembly vertically by striking upward on an end of the projectile rod assebmly.

FIG. 9 shows how the cushioning effect of the cup 22 in the first position permits the projectile rod assembly to be dynamically sustained by cyclically striking upwardly on the bottom cup 22 of the projectile rod assembly 10. The cups or either of them may be first driven in mid-air to the outward, axial positions shown, by stick contact as indicated.

Figure 10:
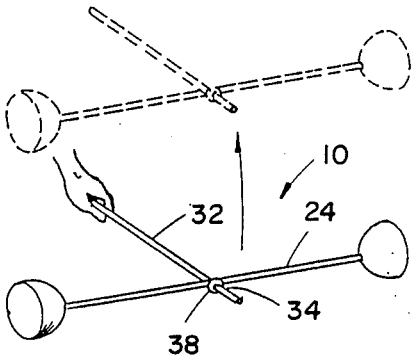
FIG. 10 is a perspective view of a lifting manipulation with a stick end guard, a successive position being shown in broken lines.

FIG. 10 shows how brim 38 of a hat-shaped guard 34 on the end of a stick 32 can be manipulated to hook under the center of gravity of the projectile rod assembly 24 and lift it free of a surface supporting it horizontally, in balanced manipulation.

Figure 11:
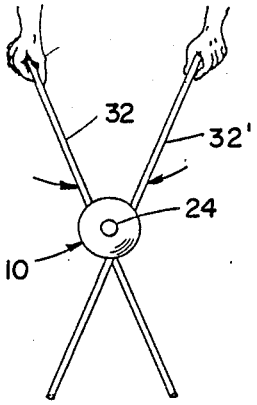
FIGS. 11*a* and 11*b* are top plan views of a scissoring manipulation of the projectile rod assembly using two stick;s
Figure 11:
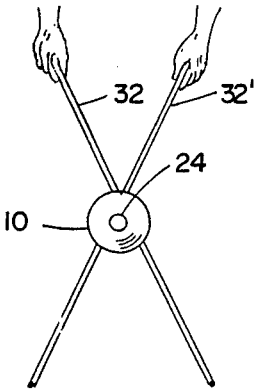

FIG. 11a shows how the rod 24 of a projectile rod asembly 10 can be caught in a "scissors" or shear grasp between angled sticks 32, 32′, expecially if the cups are respectively in different positions (one in position 1 and the other in position 3); this makes a difficult challenge. FIG. 11b shows the same apparatus with the rod 24 caught on the opposite side of the crossing of the sticks.

Figure 12:
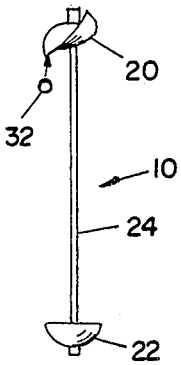
FIG. 12 is a perspective view of the projectile rod assembly with a cup in a further stable flexed position.

FIG. 12 shows in "Australian hat" position how one edge of a cup, 20 shown, can be folded outwardly while the remainder of the cup can be in the third or axially inward position. The stick 32, shown in end view, is going up to the cup where it will knock the remainder of the cup axially out, restoring the cup shape.

Figure 13:
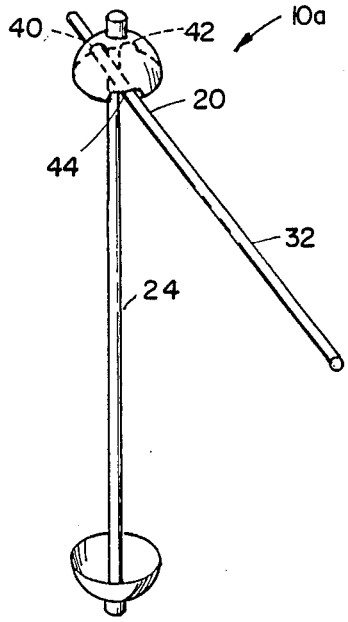
FIG. 13 is a perspective view showing an embodiment with edge scallops on a cup.

FIG. 13 shows an embodiment of the invention with the at least one cup, 20, having a plurality of scallop-shaped rim indentations 40, 42, 44 that may help engage the stick 32 on either side of the rod when manipulating the projectile rod assembly 10a. Two or three indentations or scallops may be used, preferably disposed at 180° (diametrically opposite). A pair 40, 42 of scallop indentations symmetrically disposed, is preferred, on one end of a diameter passing through the other indentation.

If two opposed indentations are used (FIG. 14) one, 44, is preferably larger than the other so that the stick may engage on either side of the rod in the larger one of them. Preferably the rim may be soft and smooth (no scallop) so that impact of the stick itself makes temporary indentations in the rim. Any unscalloped-rim views shows such.

Figure 14:
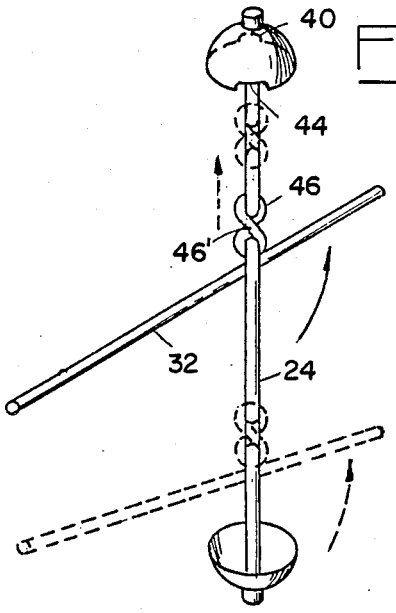
FIG. 14 is a perspective view of an embodiment with a movable structure on the rod, broken lines show some different use positions.

FIG. 14 shows also in perspective view an embodiment with a movable ring 46 slidably disposed on the rod 24 where it can be, in flight, hit with the stick 32 and driven to positions desired along the rod 24. The ring 46 is preferably of elastomeric material and double looped as at 46′ forming a figure-eight so that in-flight engagement with the stick is easier and making a bigger target for the stick. This also permits the fit to be tight enough to maintain its position on the stick unless acted upon.

Figure 15:
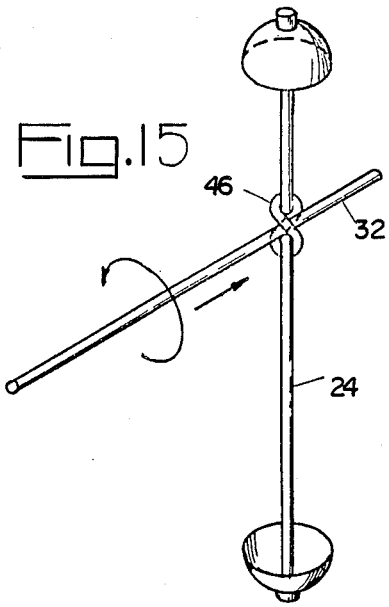
FIG. 15 is a perspective view of the FIG. 14 embodiment in a different mode of use.

FIG. 15 shows the FIG. 14 general arrangement but with the figure-eight ring 46 looped loosely enough to permit engaging the stick 32 through the ring or loop so that the stick 32 can be used to spin the projectile rod assembly like an airplane propellor in vertical or horizontal or oblique planes. It may be manually placed or stabbed through the ring when at rest, and can be disengaged in-flight as a part of a juggling routine.

Figure 16:
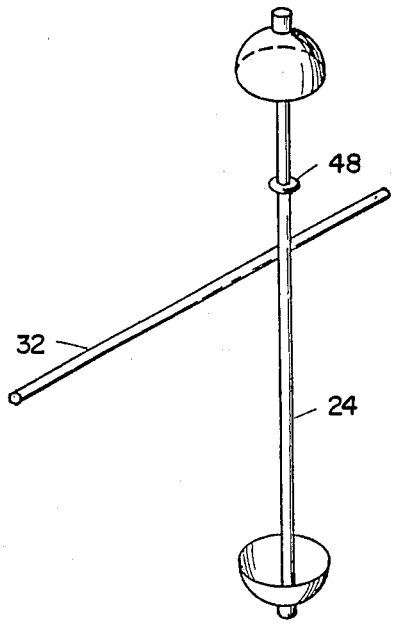
FIG. 16 is a perspective view showing a ring form of movable structure in use.

FIG. 16 shows a ring 48 in a single loop around the rod 24. In operation the ring is hit and slid as before along the rod 24 by the stick. There is no crossover position as in the figure-eight loop. In addition, ring 48 can be looped loosely enough to permit engaging the stick 32 through the ring or loop so that the stick 32 can be used to spin the projectile or horizontal or oblique planes. It may be manually placed or stabbed through the ring when at rest, and can be disengaged in-flight as a part of a juggling routine.

INDUSTRIAL APPLICATION

The following examples indicate how my invention can be used to challenge and to train users of the system, to train salesmen to demonstrate the system, and as an improved exercising system, as well as amusing audiences. The coaxial position of either or both cups 20, 22 can be altered in shape manually by flexing one or both cups axially back or forward over themselves, altering the overall length, visual appearance and balance or the projectile rod assembly, presenting different degrees of difficulty in catching and manipulating during juggling and exercising, from the easiest position (for many people) with both cups concave inwardly, to the asymmetric of hardest position with one cup oriented inwardly and the other cup oriented outwardly. A special challenge is provided by the flexed-cup positions that can be hammered by the stick to other described positions in mid-flight. Further challenges are provided in sustaining the projectile rod assembly by manipulation with the stick or sticks to form (sink into) a temporary scalloped edge, both of which can tend to hold the stick better than if absent, during manipulation. Manipulating the "O"-ring structures described also presents new challenges and amusements.

I claim:

1. A juggling system having: at least one stick, a projectile rod assembly for dynamic sustainment by manual manipulation of the projectile rod assembly using thereagainst blows of said at least one stick, the projectile rod assembly being of the type having a rod with first and second ends, and a respective enlargement axially disposed on each of the first and second ends, characterized by: means for changing said dynamic sustainment characteristics of the projectile rod assembly, including: each of the enlargements having cup shape with a rim and a stable first position with the cup shape facing coaxially outward on the rod, the enlargements being of a flexible material, and said rim having a diameter permitting the cup shape to be partially reversed by being flexed axially back over itself to a second position providing for a portion of said at least one stick to be engaged in said partially reversed cup shape at said second position, as an aid in dynamic sustainment.

2. The juggling system of claim 1, further characterized by said rim diameter and elastomeric material being so proportioned as to permit the cup shape to be fully-reversed over itself past the second position to a stable third position at which the cup shape is fully extended coaxially inwardly on the rod.

3. The juggling system of claim 2, further characterized by: a loop of elastomeric material fitting around said rod slidably along said rod under said blows of the stick thereby changing said dynamic sustainment characteristics of the projectile rod assembly.

4. The juggling system of claim 3, wherein the loop of elastomeric material has a fit on said rod permitting engagement of said stick therewith by insertion of said stick thereunder during said dynamic sustainment, thereby providing for twirling said projectile rod assembly about said engagement and for disengaging said stick from said engagement during and as a part of said dynamic sustainment.

5. The juggling system of claim 3, further characterized by said loop of elastomeric material being doubly looped forming a figure-eight with a portion engageable by said stick during said dynamic sustainment in a manner permitting twirling said projectile rod assembly by said stick.

6. The juggling system of claim 1, further characterized by said rim having structure defining a plurality of scalloped portions in said rim permitting engagement of the stick therein on either side of the rod.

7. The juggling system of claim 6, further characterized by said scalloped portions being unequal in size and diametrically opposed.

8. The juggling system of claim 6, further characterized by said scalloped portions being three in number, two paired and a third remote, in symmetrical disposition, permitting the stick to engage at one time either of said paired two and said third scalloped portion.

9. The juggling system of claim 1, said rim being substantially soft and resilient whereby impact of the stick on the rim produces a scalloped shape in the rim temporarily.

10. The juggling system of claim 1, said at least one stick having thereon an enlarged end shaped for engaging said projectile rod assembly during said dynamic sustainment.

11. A process for changing the shape of a projectile rod assembly which includes a rod-mounted flexible cup and which is maintainable in-flight by upward blows from stick onto the rod and flexible cup, comprising the steps:

(a) providing first and second stable positions of the flexible cup relative to the rod; said first and second stable positions of the cup relative to the rod being different from each other;

(b) causing a blow from the stick to drive the flexible cup from the first of said stable positions to the second of said stable positions while the projectile is in flight; thereby changing the shape of the projectile rod assembly;

12. The process of claim 11, wherein said first of the stable positions is a position with the flexible cup in a folded position on the rod relative to the second of said stable positions.

13. The process of claim 12, wherein said folded position is a position in which the flexible cup is axially inverted relative to the second of said stable positions.

14. A process of varying a juggling characteristic of a flying rod of the type kept in flight by blows from a juggling stick, comprising the steps:

(a) providing on said flying rod a flexible member with at least a part displaceable along said flying rod, and (b) during said flight striking said flexible member with said juggling stick and flexibly displacing said at least a portion of the flexible member relative to said flying rod, thereby varying said juggling characteristic of said flying rod.

* * * * *